181-196 SR
FIP3110 OR 3,963,094

United States Patent [19]
Nowikas

[11] 3,963,094
[45] June 15, 1976

[54] MUFFLER STRUCTURES

[75] Inventor: Walter M. Nowikas, Morris Plaines, N.J.

[73] Assignee: Donley, Miller & Nowikas, Inc., East Hanover, N.J.

[22] Filed: July 11, 1974

[21] Appl. No.: 487,571

[52] U.S. Cl. ..... 181/198; 52/144; 181/33 G; 181/50; 181/56; 181/33 K
[51] Int. Cl.[2] ..... E04B 1/99
[58] Field of Search ..... 181/33 G, 33 GB, 33 K, 181/198, 42, 50, 46, 56; 52/145, 198, 404, 407, 503, 505, 302

[56] References Cited

UNITED STATES PATENTS

| | | | |
|---|---|---|---|
| 2,272,829 | 2/1942 | Bohnsack | 181/33 G UX |
| 2,297,609 | 9/1942 | Clark et al. | 181/33 GB UX |
| 2,328,761 | 9/1943 | Wamnes et al. | 181/33 GB UX |
| 2,704,504 | 3/1955 | Wilkening | 181/33 GB UX |
| 3,061,056 | 10/1962 | Kodaras | 181/33 |
| 3,273,297 | 9/1966 | Wehe | 181/33 G UX |
| 3,295,273 | 1/1967 | Wehe | 181/33 GB UX |

OTHER PUBLICATIONS

*Handbook of Noise Control* Ed. by C. M. Harris McGraw-Hill Book Co., Inc. N.Y. 1957 pp. 21–25.

*Noise Reduction* Ed. by Leo L. Beranek, McGraw-Hill Book Co., Inc., N.Y. 1960 p. 153.

Egan, M. D. *Concepts in Architectural Acoustics* McGraw-Hill Book Co., Inc. N.Y. 1972, p. 65.

*Primary Examiner*—John Gonzales
*Attorney, Agent, or Firm*—Martha G. Pugh

[57] ABSTRACT

An enclosure for isolating noise sources composed of four walls and a ceiling, in which some or all of the sides and top consist of a muffler barrier including one or more air paths transverse to the principal direction of sound transmission through the structure. Various types of component muffler barriers are illustrated which include double leaf structures lined with sound absorbing material where the two leaves are disposed in spaced apart relation and include oppositely disposed air intakes and air exhausts to provide the intervening air paths. In one embodiment, components comprise corrugated panels of sound absorbing material disposed in face-to-face relation to provide multiple air channels.

4 Claims, 24 Drawing Figures

MUFFLER STRUCTURES

BACKGROUND OF THE INVENTION

This relates in general to acoustical isolating systems, enclosures and the structural components thereof and, more particularly, to muffler barrier structures.

In many cases, stationary equipment which creates excessive noise does not lend itself to controls at the source. It is rarely economically feasible for a manufacturer to be able to redesign or replace an existing machine merely for the purpose of noise control. Moreover, quieter machines which are characterized by performance at the same level of efficiency may not be available in the market.

In the present state of the art, it is generally understood that materials such as steel, wood, plastics, etc. are characterized by sound transmission loss properties; and, when one or more such materials are interposed between a sound source and receiver, a noise reduction occurs at the receiver. The solution available to control the noise of stationary equipment at the present state of the art usually involves either partial or total enclosure of the equipment, employing structural barriers formed from such materials. This solution presents the following difficulties.

Partial enclosures are usually characterized by inefficient noise attenuation and are formed in complicated designs which interfere with production.

Conventional total enclosures, in order to be acoustically efficient, must be air-tight. This may result in excessive heat build up around the equipment, reducing the life and efficiency of the machinery, thereby adding to production costs.

Where air flow is essential, the prior art practice has been to insert into the wall or ceiling exhaust and intake mufflers as separately designed component additions, with the attendant cost increases in design and materials and the risk of mismatch of attenuation capabilities of the components of the overall structure.

SUMMARY OF THE INVENTION

Accordingly, it is the principal object of this invention to provide improved methods and structures for acoustically isolating the noise of stationary equipment.

More particular objects are to provide noise isolating equipment which tends to minimize the heat build up in the machinery enclosure. A further object is to eliminate the necessity for separately designed component additions. Another object of the invention is to provide noise isolating structures which are less costly, in that they are designed as integrated noise control systems which inherently provide needed air flow.

These and other objects are realized in accordance with the present invention, in an enclosure consisting of muffler barriers, each of which is designed to include an air flow path transverse to the principal direction of sound transmission through the structure wherein the sound transmission loss of the barrier approximates the sound attenuation of the air path.

A structure of the type indicated may take the form of an enclosure for isolating one or more sources of sound, which comprises four muffler walls and a muffler ceiling, each comprising double leaves supported in slightly spaced apart relation by acoustical isolating means. Each of the muffler walls and the muffler ceiling has a pair of orifices for air intake and exhaust at opposite ends thereof, and includes in the intervening internal air path sound absorbing and/or sound dissipating materials in configurations designed to provide sound attenuation yet providing air flow with substantially no change in the attenuation capability of the barrier. In accordance with a preferred form of the present invention, a structure is designed in which the insertion loss approximates the transmission loss in at least three of the octave bands in the frequency range between 125 and 8000 hertz.

In one embodiment, the muffler barrier wall and ceiling structures may each take the form of a pair of rigid parallel leaves comprising, for example, sheets of steel (painted or unpainted), plastic, wood or aluminum. These are spaced apart longitudinally by channels, acousticsl studs or isolators which divide the structure into substantially longitudinal sections. Alternatively, other channel-type longitudinal dividers may be used. The rigid leaves are internally lined with sound absorption materials, individually or in combination, such as glass fiber, mineral wool, open cell foam material, sintered or compacted metallic material, spray-on cellulose material or felt fibrous material. In one alternative form, the intervening space between the walls can be designed in the form of multiple Helmholtz resonators of, for example, one octave band attenuation capability. At the terminals of the air path between the inner sheets of acoustical absorbing material, air intake and exhaust orifices are respectively provided by a first series of rectangular slots at the upper end of the left-hand wall and a corresponding second series of rectangular slots at the lower end of the right-hand wall.

In accordance with a modification, one or more lateral separators, comprising sound absorbing material, are interposed in addition to the longitudinal separators. Instead of one long chamber, this provides two or more short chambers of reduced air path length.

A structure of one of the types described may be modified by providing overall perforations in one of the rigid leaves. A further modification involves lining the inside of the perforated leaf with layers of absorption material and an impervious septum.

In accordance with another modification, the lining materials bonded to the inner sides of the rigid leaves are corrugated to provide between them an air path which is not line-of-sight in a longitudinal direction.

Another form of the present invention is particularly facilitated for volume fabrication. This comprises a pair of galvanized steel backers to each of which is bonded a glass fiber board which has been shaped to include longitudinal sawtooth grooves. The grooved sheets are bonded together so that the inwardly directed grooves form between them a series of air channels. Air intake and exhaust slots are respectively cut into the upper end of one sheet and the lower end of the other sheet. A similar type muffler structure is made especially for ceilings, in which a rectangular intake opening is cut centrally in the lower one of the pair of bonded panels, the air being exhausted in both directions towards the two ends of the channels.

A particular feature of the muffler enclosure of the present invention is that it provides a simple barrier structure, economical to construct, which combines the function of sound barrier and muffler and which permits maximum air flow therethrough with no substantial reduction in the composite sound transmission loss through the structure.

Other objects, features and advantages of the various techniques and structural combinations in accordance with the present invention will be better understood from a detailed study of the invention in connection with the drawings hereinafter.

DETAILED DESCRIPTION OF THE INVENTION

The present invention relates to an enclosure consisting of a plurality of self-standing mufflers and ceiling units which, when assembled, serve to provide total acoustical isolation for one or more sound sources or receivers. The enclosure of the present invention is constructed to be mounted on a base which may or may not be the existing floor. The muffler wall and ceiling components of the system of the present invention may take numerous different forms, serveral of which are described with reference to FIGS. 1–20 of the drawings, the complete acoustical isolating system being shown in FIGS. 21 and 22.

Muffler barrier structures designed for use in the assembly of the present invention are composite in form to permit air circulation through the structure while providing adequate noise reduction for most stationary noise sources.

It has been found that most equipment realizes sound pressure levels of between 90 dB-A and 110 dB-A weighted. Since a reasonable noise level criterion can be set at about 80 dB-A, the design goal of muffler equipment and transmission loss structures is to provide a noise reduction of between 10 dB-A and 30 dB-A weighted.

In order to accomplish these goals, in accordance with the teachings of the present invention, a wall design is contemplated wherein the sound transmission loss through the structure approximates the insertion loss in the air passage directed transversely through the structure, that is:

$$TL \cong IL \quad (1)$$

where $$TL = 10 \log \frac{1}{\bar{\tau}}$$

$$\bar{\tau} = \frac{\int_0^{\theta lim} \tau(\theta) \cos\theta \sin\theta \, d\theta}{\int_0^{\theta lim} \cos\theta \sin\theta \, d\theta}$$

$$\tau(\theta) = \frac{I_{trans.}}{I_{inc.}} = \frac{|p_t^2|}{|p_i^2|}$$

and where

I = sound intensity watts/m$^2$

Pa = pascals (N)/(m$^2$)

$p$ = sound pressure Pa inc. = incident trans. = transmitted $\theta$ = angle of sound incidence $m$ = meters N = newtons and $$IL = L_{p_{in}} - L_{p_{out}}$$

where

IL is measured in dB re 20μPa; and $L_{p_{in}}$ and $L_{p_{out}}$ = sound pressure levels measured in above units at the intake and exhaust openings of the muffler portion of said unit, respectively.

From a practical standpoint, it has been determined that a muffler wall in accordance with the present invention is preferably between 1 and 5 inches thick. Typical modular dimensions may be, for example, 4 feet wide by 4 feet, 6 feet, 8 feet or 10 feet long.

Since the noise spectra from different types of equipment varies, the requirements for noise reduction relative to frequency spectra must vary in a corresponding manner.

A number of specific examples of structures suitable for the muffler barrier enclosure of the present invention will now be described in detail with reference to the drawings.

Figure 1:
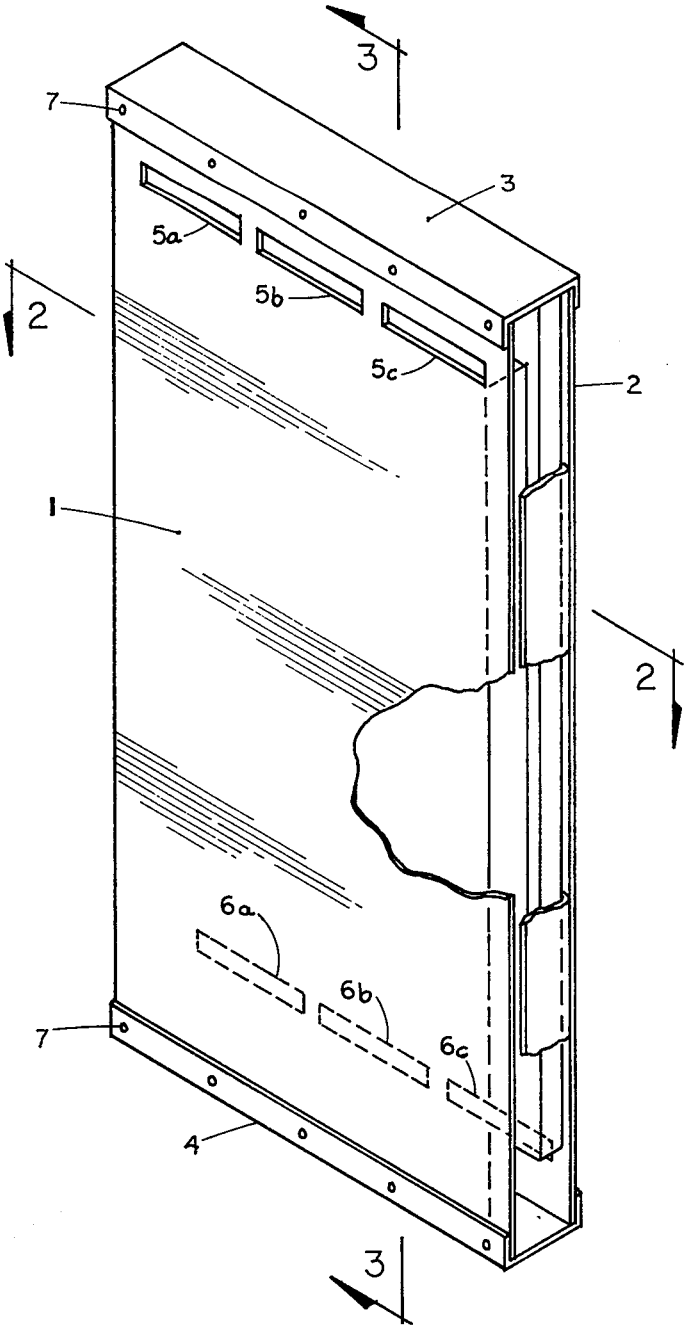
FIG. 1 shows in perspective a muffler wall component in accordance with the present invention, formed of a pair of rigid parallel metal sheets, having internal facings of absorption material, which are separated into longitudinal sections by isolating rails spaced apart.

FIG. 1 shows a typical example of a muffler wall suitable for the structure of the present invention. This comprises a pair of rigid leaves 1 and 2, which in the present example are rectangular, 8 feet by 4 feet, and are formed of 20 gauge galvanized sheet steel. In the alternative, rigid plastic or aluminum sheets can be employed. It will be understood that these sheets can be painted or unpainted. Leaves 1 and 2 are disposed in parallel relation, spaced apart, so that the distance between their exteriors is 4 inches, being accommodated at their upper and lower ends in a pair of extruded or formed channels 3 and 4. In the present example the latter are formed of 16 gauge galvanized sheet steel which may be painted or unpainted. In the alternative, it will be understood that channels 3 and 4 can also be formed of rigid plastic or aluminum. The channels 3 and 4 each have an internal base dimension of 4 inches and have peripheral flanges, say, 2 inches deep which brace the ends of leaves 1 and 2. A series of screws or studs 7 serve to fasten the channels 3 and 4 in place to the upper and lower ends of leaves 1 and 2. These may comprise rivets, self-tapping screws, tack welds, spot welds or spring clips or the like. Near the upper end of leaf 1 and the lower end of leaf 2 are rectangular slots, respectively, *5a*, *5b* and *5c* on the former and *6a*, *6b* and *6c* on the latter. In the embodiment under description, these are fourteen inches long and two inches wide. Slots *5a*, *5b* and *5c* are symmetrically aligned parallel to the top of leaf 1, their upper edges about three inches below the top. Slots *6a*, *6b* and *6c*, indicated in dotted lines, are similarly aligned with their lower edges three inches above the bottom edge of leaf 2. The middle slots *5b* and *6b* are centered in the respective side walls with the other two slots in symmetrically spaced aligned relation, separated by a distance of about two inches on each side thereof.

For the purposes of acoustically isolating and supporting leaves 1 and 2 in the desired spaced apart relation, a series of isolator rails 8, 9, 10 and 11 are interposed longitudinally in the structure, the rails 8 and 9 respectively in the two end positions and rails 10 and 11 symmetrically disposed in intermediate positions which conform with the lateral spacings between slots *5a*, *5b* and *5c* and *6a*, *6b* and *6c*. The isolator rails 8, 9, 10 and 11 include as a central element a parallelapiped of 60 durometer rubber, 1 inch by 2 inches in section. Opposite inner ends of pair of 16 gauge galvanized sheet steel angles are bonded to the two inches wide opposite faces of the rubber parallelapiped, so as to form a rectangular configuration with an open space at each side, the inwardly directed opposite angle ends being respectively bonded to adjacent inner faces of the leaves 1 and 2.

In the vertical sections between the isolator rails 8, 9, 10 and 11 are interposed linings of absorption materials, such as glass fiber, mineral wool, open cell foam material, sintered or compacted metallic material, spray or cellulose material or felt fibrous material. In the specific example under description, sections of leaf 1 are each lined with a 1½ inches thick layer of glass fiber which, for example, may take the form of "Fiberglas 702", a product sold under the trademark of Owens-Corning Fiberglas Corporation. The glass fiber panels 12, 13 and 14 are respectively 16 inches wide and 7 feet, 7 inches long, extending in leaf 1 from the bottom to just below the openings *5a*, *5b* and *5c*.

Bonded to the inner surface of leaf 2 are panels 15, 16 and 17 of sound absorbing material which may take similar forms to those indicated with reference to panels 12, 13 and 14. In the specific embodiment under description, panels 15, 16 and 17 have similar dimensions to panels 12, 13 and 14, except that the former are thinner, being only one inch thick, and comprising glass fiber which takes the form of "Fiberglas 705", manufactured under the trademark of the Owens-Corning Fiberglas Corporation. Panels 15, 16 and 17 extend from the top of leaf 2 to just above openings *6a*, *6b* and *6c*. This leaves an intervening space about 1 inch wide between the absorbing linings, which extends nearly the entire length between parallel leaves 1 and 2, providing a sound attenuated air path extending between openings *5a*, *5b* and *5c* at one end and *6a*, *6b* and *6c* at the other end.

Figure 5:
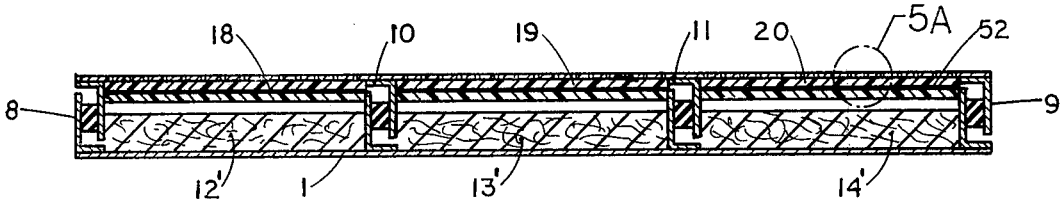
FIG. 5 is a cross-section along the plane indicated by the arrows 5—5 of FIG. 4.
Figure 4:
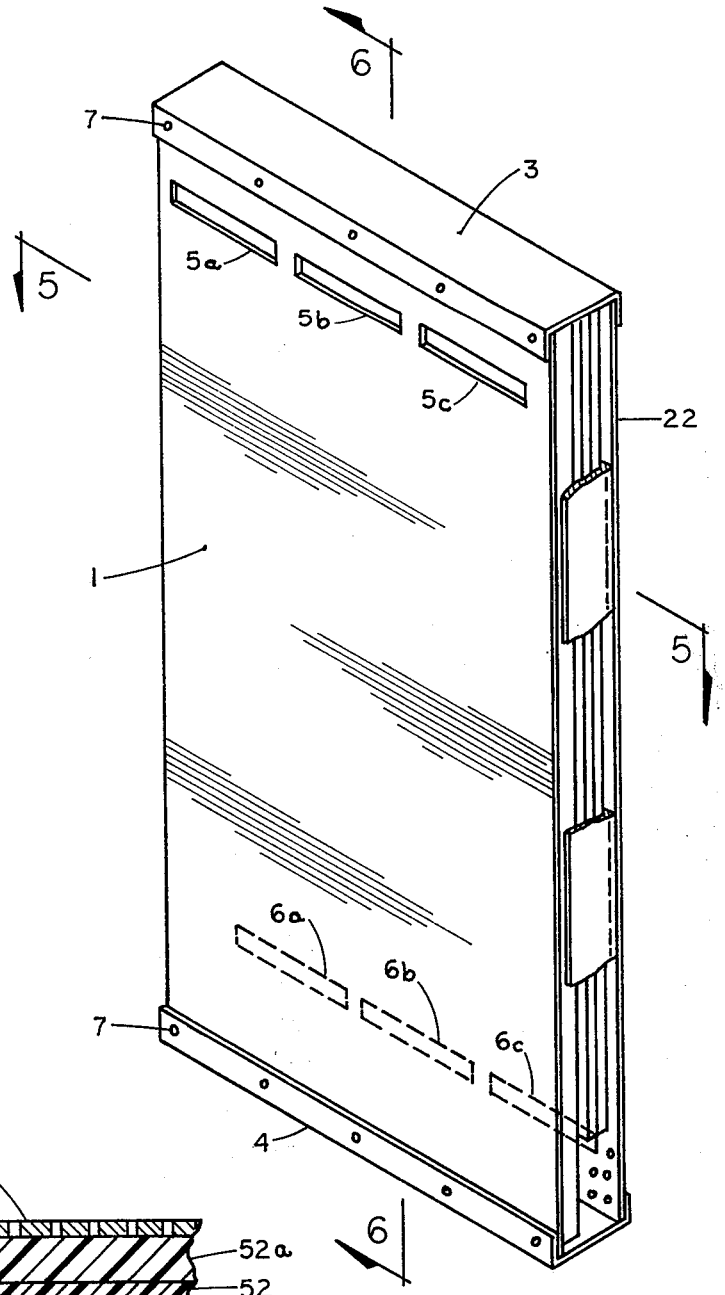
FIG. 4 shows in perspective a modification of the muffler wall component of FIG. 1, including longitudinally disposed isolator rails, in which at least one of the external metal sheets is perforated and faced internally with two layers of foam absorbing material bonded to either side of a transmission-loss material.
Figure 5A:
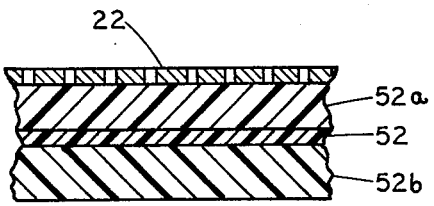
FIG. 5A is an enlarged section of a portion of FIG. 5.
Figure 6:
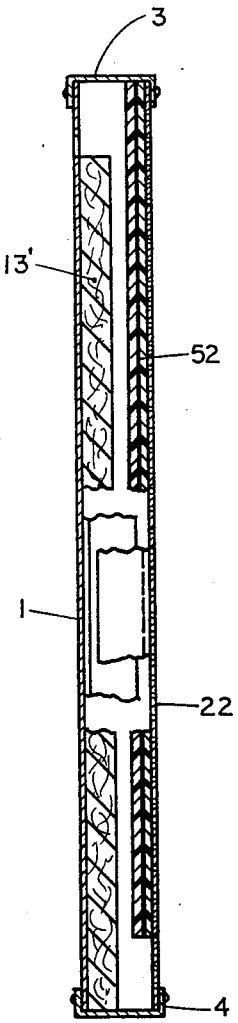
FIG. 6 is a longitudinal section along a plane indicated by the arrows 6—6 of FIG. 4.

It will be apparent that many variations are possible in panel wall or ceiling configurations and materials. FIGS. 4, 5 and 6 of the drawings are of the same general rectangular configuration and overall dimensions of FIGS. 1, 2 and 3, just described. Panels 12', 13' and 14' comprise 2 inches thick layers of glass fiber (preferably "Fiberglas 705") bonded internally to metal leaf 1. Replacing the solid metal leaf 2 of FIGS. 1 et seq. is a perforated sheet 22, which is, for example, 20 gauge galvanized sheet material having 20% open area in the form of overall perforations having ⅛ inch diameter, with their centers spaced apart ¼ inch. Bonded to an internal face of perforated wall 22 are panels 18, 19 and 20 which replace panels 15, 16, 17 of FIG. 1. Each of the former comprises a lead, mastic or other transmission-loss material sheet 52 with a ½ inch thick layer of open cell polyurethane foam *52a*,*52b* on its two sides. The purpose of the perforations is to allow an absorptive surface for sound waves incident to the barrier. These waves pass through the perforated surface to the foam, but are then blocked by the transmission-loss septum. This design minimizes the reflective build-up of sound energy within the enclosure while maintaining the transmission-loss capabilities of a double leaf structure. FIG. 5A should be noted, showing in enlarged section the septum 52 fastened on two sides *52a*,*52b* with polyurethane foam.

Figure 2:
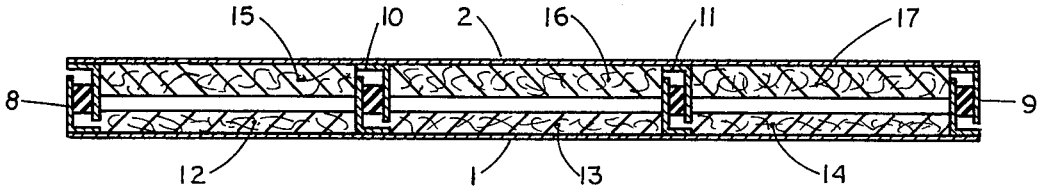
FIG. 2 is a cross-section along the plane indicated by the arrows 2—2 of FIG. 1.
Figure 3:
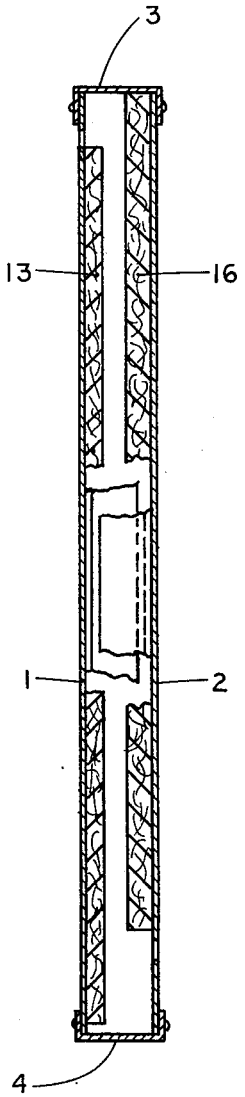
FIG. 3 is a longitudinal section along a plane indicated by the arrows 3—3 of FIG. 1.
Figure 8:
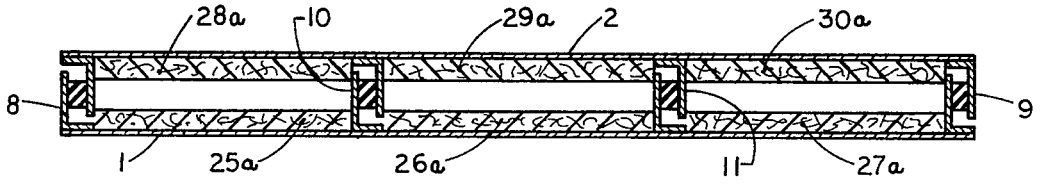
FIG. 8 is a cross-section along the plane indicated by the arrows 8—8 of FIG. 7.
Figure 7:
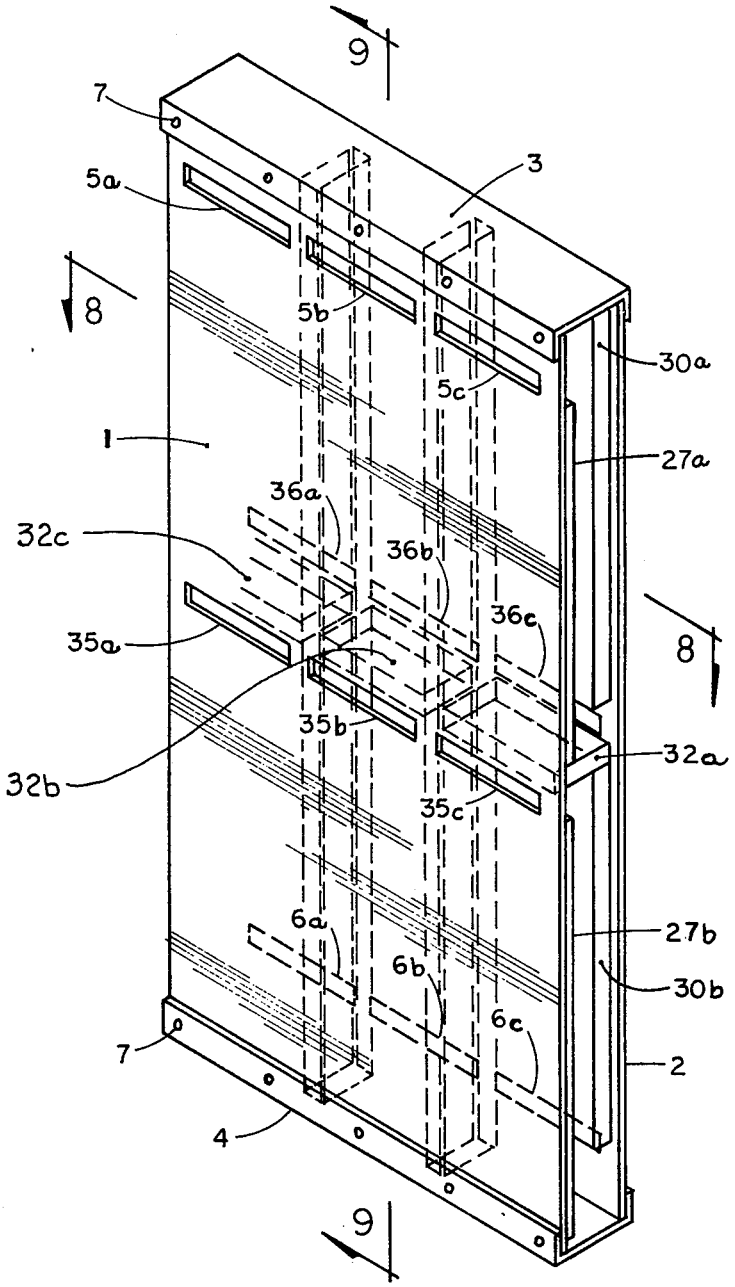
FIG. 7 shows another modified form of muffler wall component in accordance with FIG. 1, including longitudinally disposed isolator rails, wherein a glass fiber divider is interposed intermediate between upper and lower sections of the structure.
Figure 9:
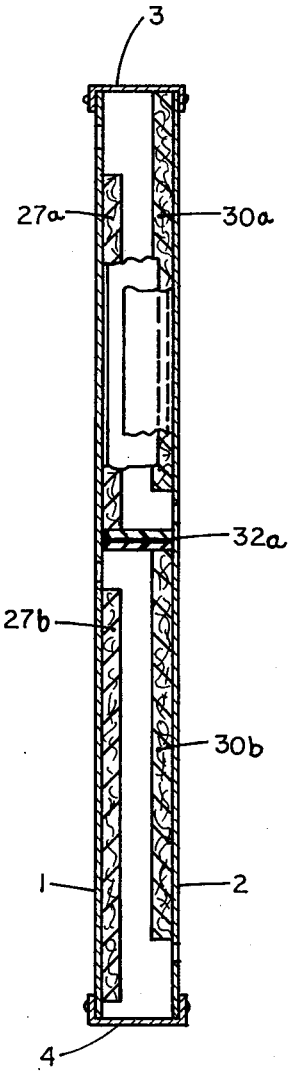
FIG. 9 is a longitudinal section along a plane indicated by the arrows 9—9 of FIG. 7.

FIGS. 7, 8 and 9 respectively show in perspective, cross-section and longitudinal section, another modified form of the component of FIGS. 1, 2 and 3 in which the air path chambers are divided laterally as well as longitudinally. As in FIG. 1, the galvanized sheet steel leaves 1 and 2 are held 4 inches apart in parallel relation by means of the 16 gauge galvanized steel and channels 3 and 4. As in FIGS. 1–3, four symmetrically spaced vertical isolator studs 8, 9, 10 and 11 extend the length of the structure, which divide the wall into longitudinal panels, the studs 8 and 9 forming end panels, and, the studs 10 and 11 being interposed symmetrically therebetween the conform in position with the spacings between one set of air intake slots 5*a*, 5*b* and 5*c* and one set of air exhaust slots 6*a*, 6*b* and 6*c*. In this component, leaves 1 and 2 are each lined with a one inch thick layer of sound absorbing material which in the component under description may be, for example, a product sold by the Scott Paper Company under the trademark "Scottfelt 900-3".

The chambers formed between leaves 1 and 2 are divided laterally by three composite dividers 32*a*, 32*b* and 32*c* disposed along the same horizontal plane, mid-way between and parallel to end channels 3 and 4. Each of the composite dividers 32*a*, 32*b* and 32*c* is similar in form to the transmission-loss sheet 52 of the previously described embodiment (FIG. 5A), which comprises a lead, mastic or other transmission-loss sheet sandwiched between two ½ inch thick layers of open cell polyurethane foam 52*a*,52*b*. Each of composite dividers 32*a*, 32*b* and 32*c*, 4 inches wide and about 14⅔ inches long, is fastened between the leaves 1 and 2 by retainers, adhesive or the like, and is disposed in abutting relation between a corresponding pair of vertical isolator studs. In leaf 1, aligned with and extending just below the lower face of dividers 32*a*, 32*b* and 32*c* is a second series of openings 35*a*, 35*b* and 35*c* which are substantially similar in dimension and alignment to the upper openings 5*a*, 5*b* and 5*c*. Likewise, on leaf 2, aligned with and just above the upper faces of dividers 32*a*, 32*b* and 32*c* is another series of openings 36*a*, 36*b* and 36*c*, which are matched in dimensions and alignment to the openings 6*a*, 6*b* and 6*c* at the lower end.

In the upper channels, the glass fiber panels 25*a*, 26*a* and 27*a*, affixed to the inside of leaf 1, are each 14⅔ inches wide and about forty-four inches long, and extend from just below the bottom edge of slots 5*a*, 5*b* and 5*c* to the upper face of the corresponding dividers 32*a*, 32*b* and 32*c*. Similar lower sound absorbing panels 25*b*, 26*b* (not shown) and 27*b* extend on the inside of leaf 1 from just below the openings 35*a*, 35*b* and 35*c* to the bottom leaf 1. Likewise, sound absorbing panels 28*a*, 29*a* and 30*a* extend internally from the top of leaf 2 to just above the slots 36*a*, 36*b* and 36*c*; and, lower panels 28*b*, 29*b* (not shown) and 30*b* extend from the bottom face of the corresponding divider 32*a*, 32*b* or 32*c* to just above the slots 6*a*, 6*b* and 6*c*.

Figure 11:
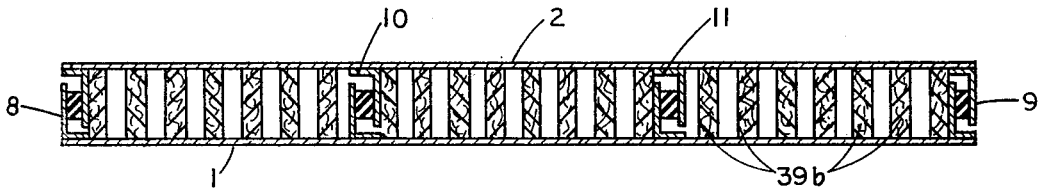
FIG. 11 is a cross-section along the plane indicated by the arrows 11—11 of FIG. 10.
Figure 10:
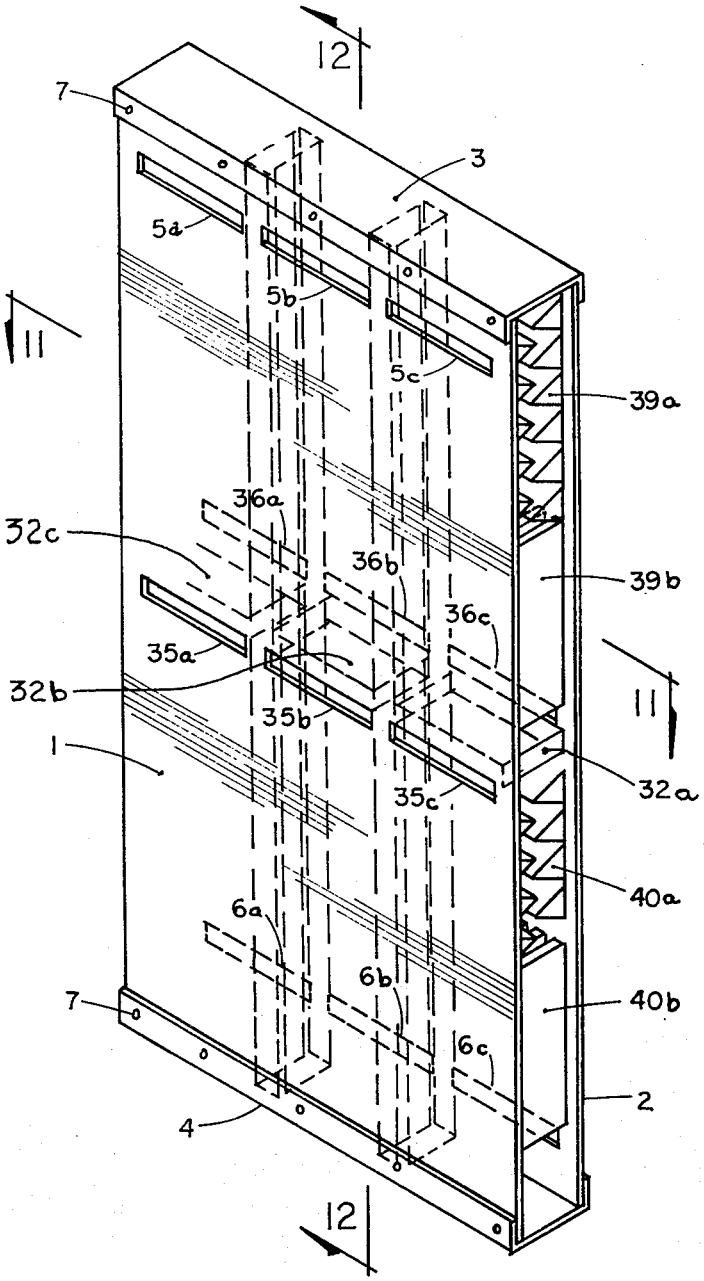
FIG. 10 shows another embodiment of muffler wall component of the present invention, including laterally divided sections as in FIG. 7; in the top half of each section the parallel metal backing sheets are lined with glass fiber sheets having sawtooth projections interposed transversely to the supporting walls so as to provide between them a zig-zag air path, vertical sections being separated by isolator rails.
Figure 12:
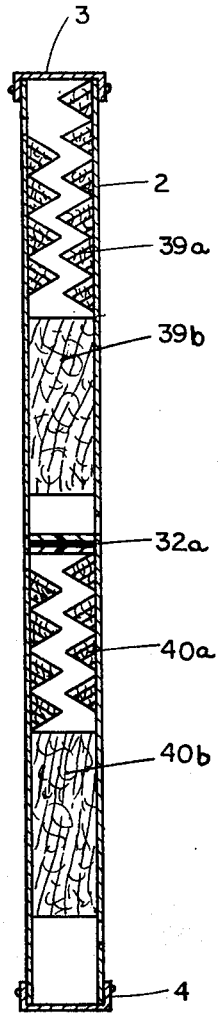
FIG. 12 is a longitudinal section along a plane indicated by the arrows 12—12 of FIG. 10.

FIGS. 10, 11 and 12 show, in perspective, cross-section and longitudinal section, respectively, a further modification of the structure described with reference to FIGS. 7, 8 and 9 wherein the flat panels of sound absorbing material, bonded internally to the leaves 1 and 2, are replaced with an arrangement of absorbing material having a saw-tooth cross-section in the upper part of each panel and a series of transversely disposed parallel slabs in the lower portion of each panel. The isolating studs 8, 9, 10 and 11 and the lateral dividers 32*a*, 32*b* and 32*c* are the same as in FIGS. 7–9.

Panel 39*a* comprises a plurality of slabs of glass fiber of triangular cross-section about 4 inches wide and 2 inches thick, arranged in parallel corrugated relation, one below the other, directed inwardly from metal leaf 2 and in off-set relation with a set of similar corrugated slabs directed inwardly from leaf 1, which form between them a zig-zag air path about 1½ inches wide. The zig-zag arrangement extends downward 2 feet below the top of the structure. The lower part of the upper panel has interposed therein a vertical series 39*b* of parallel glass fiber boards, each about four inches wide and one inch thick with 1 inch deep spaces between them. A similar arrangement is repeated below dividers 32*a*, 32*b* and 32*c* with zig-zag section 40*a* and vertical board section 40*b*. These provide a series of line-of-sight interrupted air paths extending from air intake slots 5*a*, 5*b* and 5*c* in leaf 1 to air exhaust slots 36*a*, 36*b* and 36*c* mid-way in leaf 2; and, similarly, between intake slots 35*a*, 35*b* and 35*c* and exhaust slots 6*a*, 6*b* and 6*c*.

Figure 14:
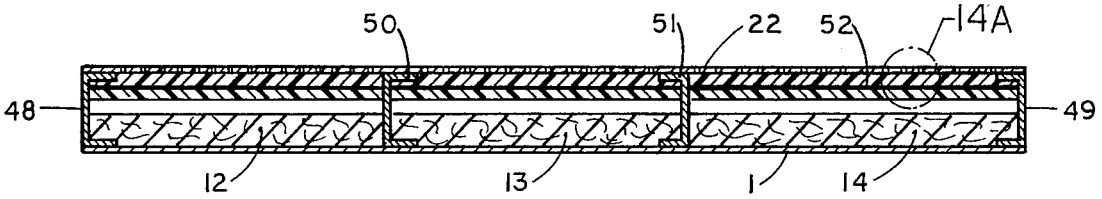
FIG. 14 is a cross-section along the plane indicated by the arrows 14—14 of FIG. 13.
Figure 13:
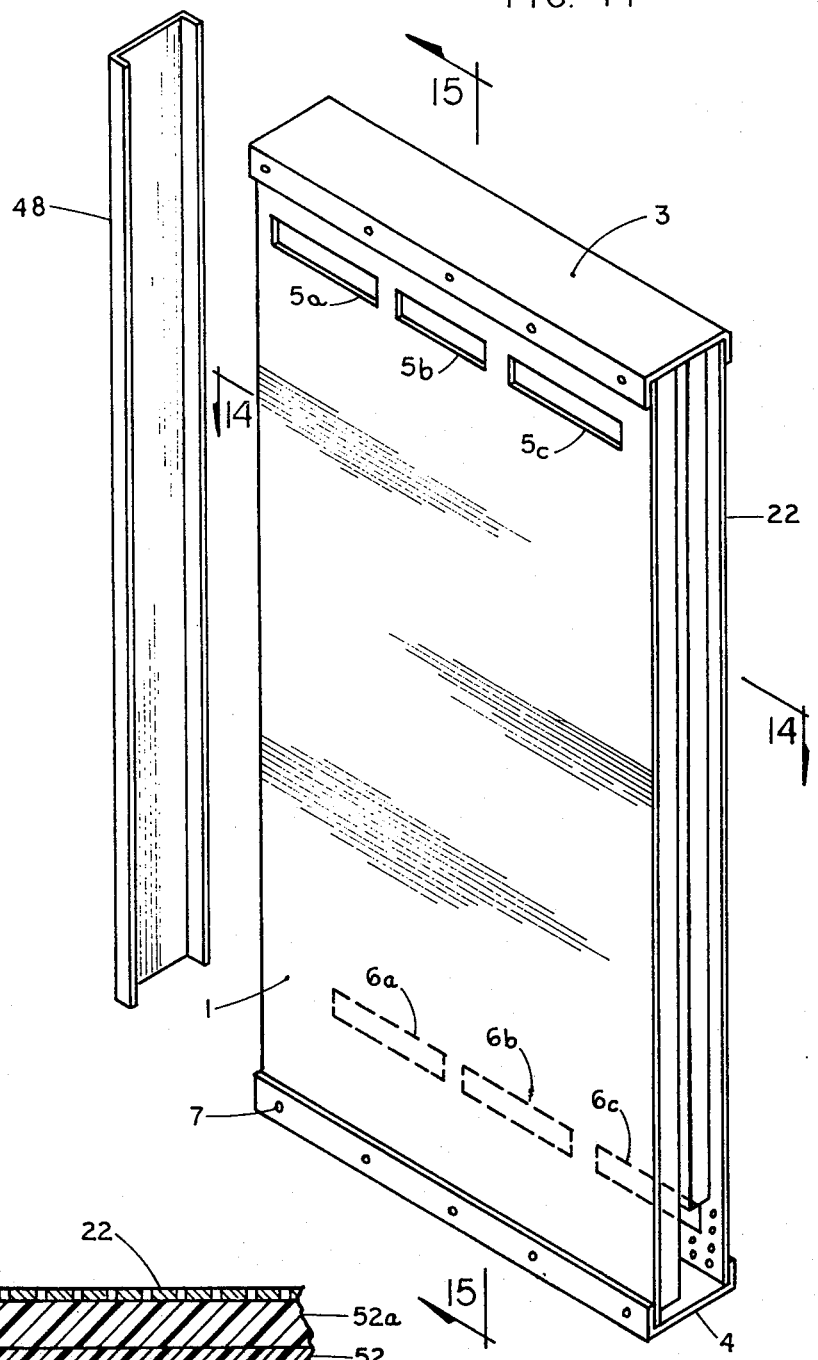
FIG. 13 shows in perspective a further modified form of muffler wall similar to the structure of FIGS. 4–6, in which the longitudinal isolator rails are replaced by vertically extending channels.
Figure 15:
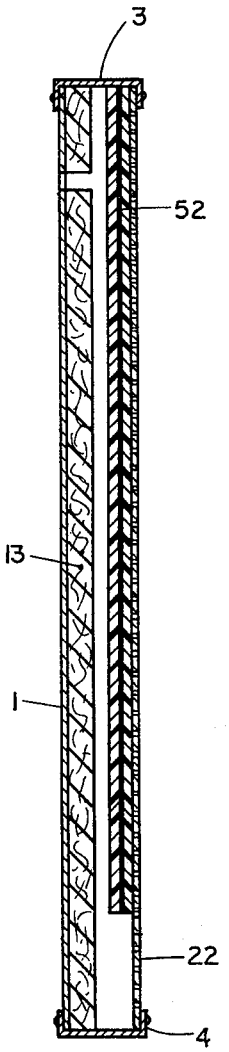
FIG. 15 is a longitudinal section along a plane indicated by the arrows 15—15 of FIG. 13.
Figure 14A:
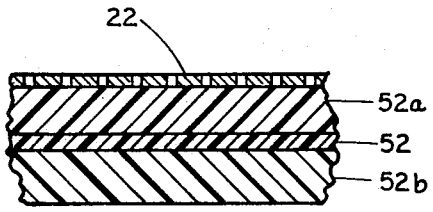
FIG. 14A is an enlarged section of a portion of FIG.

Another component is shown in perspective in FIG. 13, in cross-section in FIG. 14 and in longitudinal section in FIG. 15, a modification of the embodiment of FIGS. 3, 4 and 5, in which the longitudinally extending studs are replaced by longitudinally extending channels 48, 49, 50 and 51. In the present example, these are formed or extruded channels of 16 guage galvanized steel, the inside base dimension of which is 4 inches and having rectangular edge flanges each 2 inches deep. The channels are each 8 feet long, 48 and 49 being disposed at opposite ends to embrace between them the lateral edges of leaves 1 and 22, studs 50 and 51 being symmetrically spaced there between with their flanges directed toward one another so as to divide the muffler barrier into three substantially equal longitudinal panels. As in FIG. 4, one of the leaves 22 is overall perforated. Panels 12, 13 and 14 comprise 2-inch thick layers of glass fiber (preferably "Fiberglas 705") bonded internally to leaf 1. Bonded internally to perforated leaf 22 is a lead, mastic or other transmission-loss material sheet 52 with two layers 52*a*,52*b* of polyurethane foam attached to its two sides. As in the previously described component, these panels are 16 inches wide and extend a length of 7 feet, 7 inches from the upper end of leaf 22 to just above the upper edge of air slots 6*a*, 6*b* and 6*c*, therein.

Figure 18:
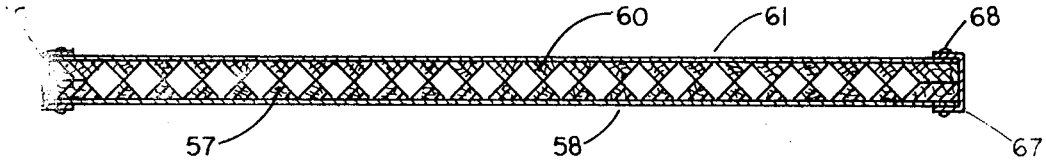
FIG. 18 is a cross-sectional showing along the line 18—18 of the structure of FIGS. 16 and 17, when in laminar assembled relation.
Figure 17:
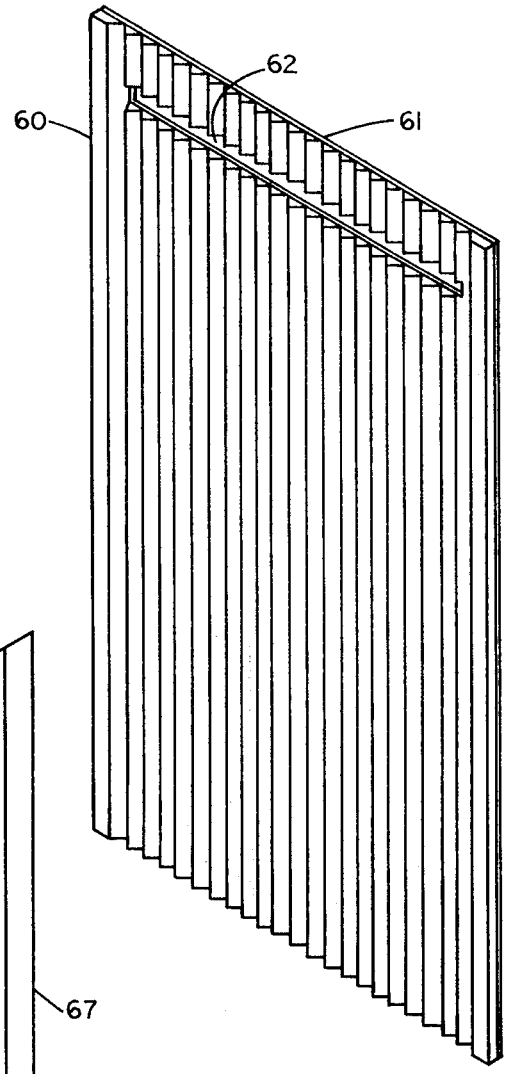
FIGS. 16 and 17 show in exploded view a modified form of muffler wall component in accordance with the present invention comprising a pair of supporting metal sheets, to the internal surfaces of which corrugated glass fiber sheetings are bonded, and edge fittings for assembling the same in face-to-face relation.
Figure 16:
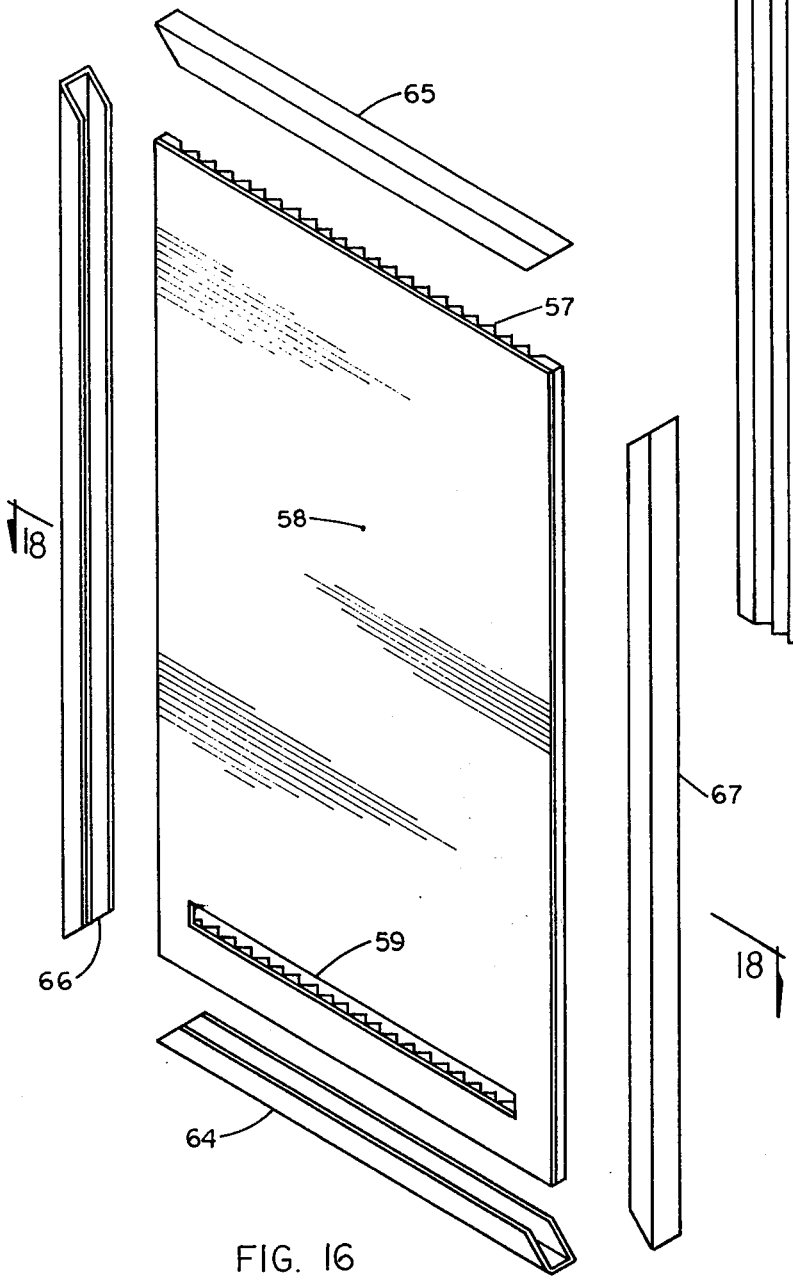

Another component of the invention, which is particularly adapted for rapid fabrication, is a laminate illustrated in FIGS. 16, 17 and 18. FIG. 16 is an exploded perspective view showing one panel of the laminate with end and side channels removed. The panel 57 may, for example, comprise a glass fiber product manufactured by the Owens-Corning Fiberglas Corporation under the trademark "Duckboard 800", 4 feet by 10 feet by 1 inch thick, which has been bonded with adhesive or otherwise secured to a matching backing element 58 of 20 gauge galvanized steel. After bonding, the "Duckboard" is formed with a series of parallel longitudinal grooves providing a saw-tooth cross-section with the adjacent angular planes related at approximately 90°. A slot 59 about 3 feet, 8 inches long and 2 inches wide is cut symmetrically with respect to the sides, about 2 inches from and parallel to the bottom edge of panel 57. A similar corrugated "Duckboard" panel 60, having a galvanized steel backing 61, has a slot 62 of equal dimensions and oppositely disposed to the slot 59 in the panel 58. The two matching panels are assembled and bonded face-to-face, being mounted together in the end channels 64 and 65 and the side channels 66 and 67. The latter are preferably formed of 20 gauge galvanized steel, two inches wide at the inside base and having 2 inch flanges on each side. The composite is fastened together with rivets 68 or welds in a manner well-known in the art. The laminar structure is thus provided with a series of parallel channels of diamond-shaped cross-section which comprise about 50% of the cubic content of the structure. Air flows in the slot at one end of the structure and out the slot at the other end thereof.

Figure 19:
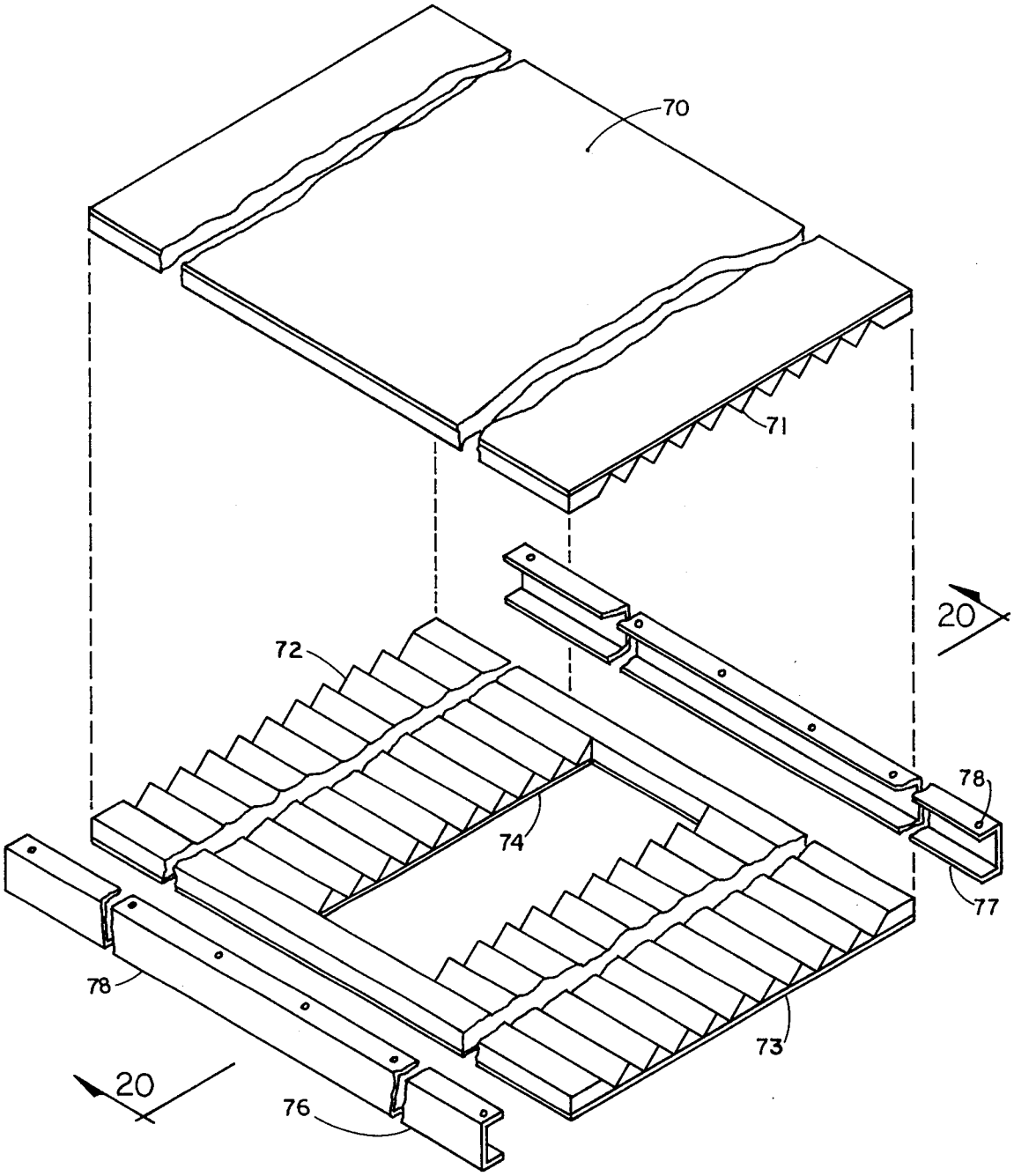
FIG. 19 is a perspective showing of a modification of the laminar structure of FIGS. 17 and 18, which is especially adapted for use on ceilings.
Figure 20:
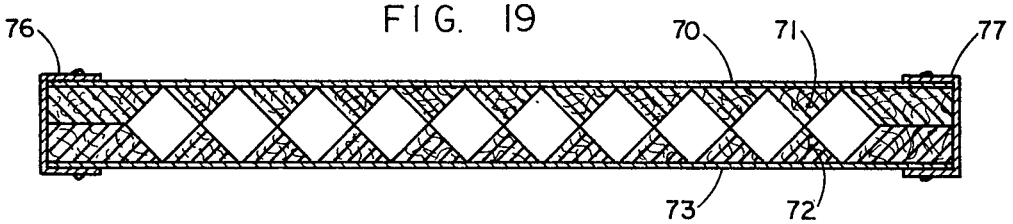
FIG. 20 is a cross-sectional showing of the laminar assembly of FIG. 19 along a plane indicated by the arrows 19—19.

A modified laminar structure for ceiling use is indicated in FIG. 19 (exploded view) and FIG. 20 (assembled section). The galvanized steel panel 70, having a corrugated glass fiber lining 71, and the galvanized steel panel 73, having corrugated glass fiber lining 72, are similar in form to those described with reference to the preceding figures, except that the panel 70–71 has no opening and in the panel 73–72 the opening 74 is centered, being substantially as indicated in the drawing. These two panels are assembled face-to-face between a pair of lateral channels 76 and 77 which are similar to the channels previously described. The composite is fastened together with rivets 78 or in any other wellknown manner. Air is exhausted through the central opening 74, passes through the longitudinal channels and out through the open ends.

Figure 21:
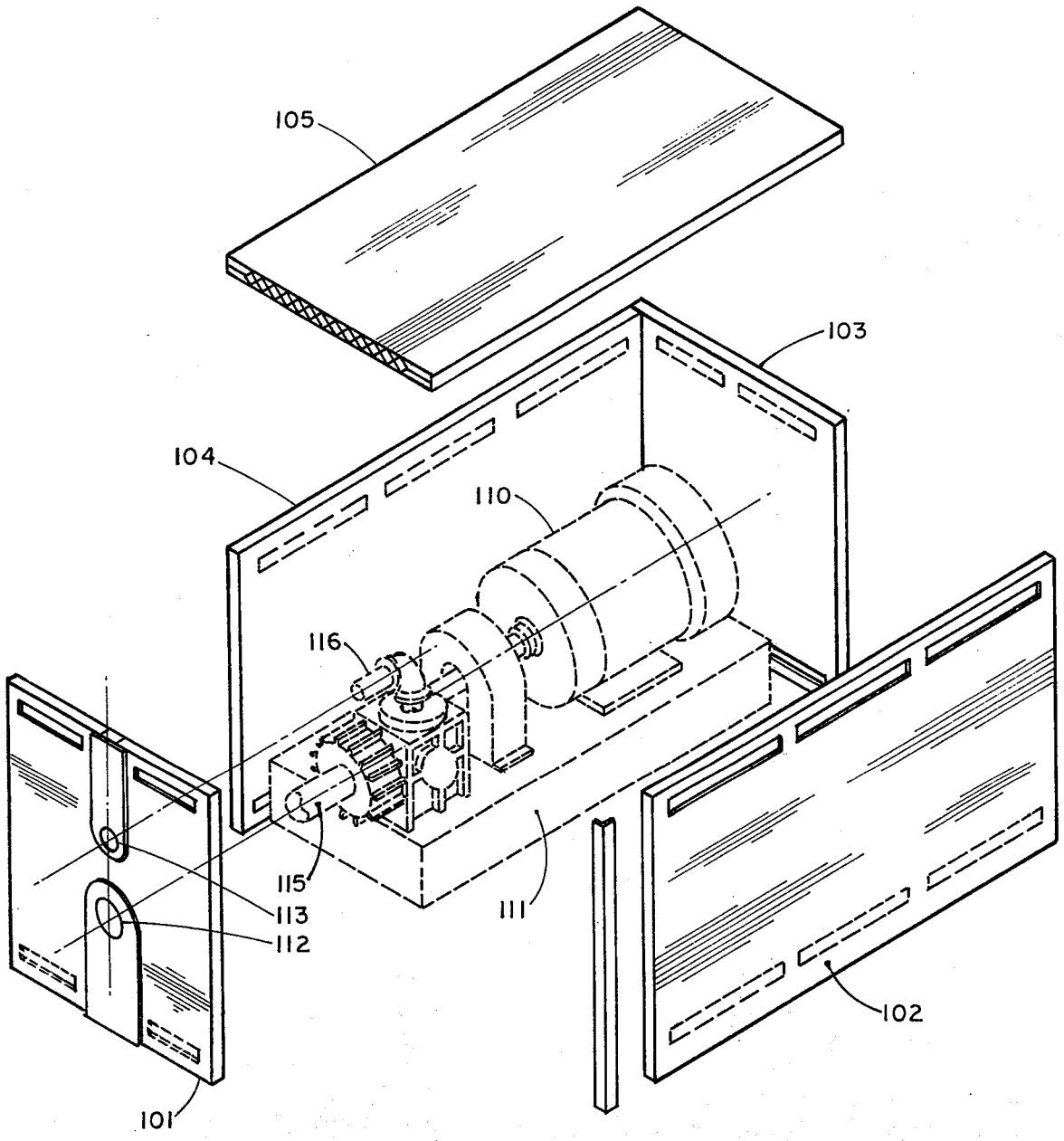
FIG. 21 is a perspective showing of a muffler wall enclosure in accordance with the present invention in the process of assembly.

In FIG. 21 of the drawings, there is shown an enclosure 100 in accordance with the present invention, consisting of four muffler walls 101, 102, 103 and 104 and muffler ceiling 105, which may be of any of the general types described with reference to FIGS. 1–20 of the drawings or their equivalents, in the process of being assembled to serve as an acoustically isolating enclosure for an oil pump 110. The enclosure is preferably affixed to the floor by means of a floor channel or, alternatively, to any other conventional base 111 on which the noise source is mounted, provided an air-tight seal is constructed between the walls 101–104 and the base. The air intake inlets of each of the muffler walls are positioned so as not to be blocked by the base member. The four walls 101–104 and the ceiling element 105 may be bolted together and to the floor or a machine supporting base, in any conventional manner and the seams caulked or gasketed to make them air-tight. For example, the bases of the walls 101–104 may be fitted into and bolted or screwed to floor channels which are bevelled or chamfered to make them fit together at the corners. Joiners comprising channels having their longitudinal openings directed to receive a pair of panels forming a 90° angle may be installed vertically at the corners. Similarly, channel members may be applied to make an air-tight seal between the ceiling member 105 and each of wall members 101–104. Channel members suitable for the purposes of the present invention are disclosed in Bulletin 6.0501.3 entitled "IAC Moduline", copyright 1973 by Industrial Acoustics Company, Bronx, N.Y.; and, installation may be carried out in accordance with the instructions set forth in IAC Moduline Layout Sheet, copyright 1972 by the foregoing company.

Figure 22:
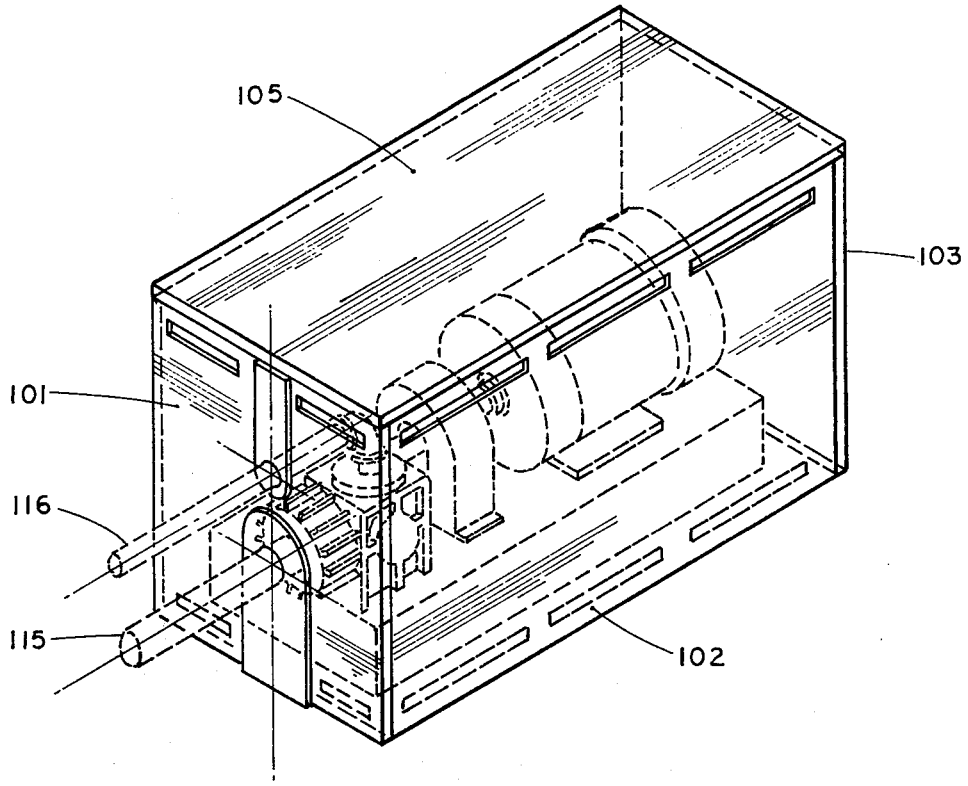
FIG. 22 is a perspective showing of a completely assembled muffler wall unit in accordance with the present invention.

FIG. 22 shows the enclosure unit of the present invention completely assembled. Assuming that the machine constituting the noise source is motor driven, one of the panels, such as 101, is equipped with reinforced openings to accommodate the drive shaft 115 and an inlet 116. These openings are fitted to make then air-tight by sealing with gaskets or a sealing compound in a conventional manner.

It will be understood that the invention is not limited to the specific structures or their components disclosed herein by way of example, but is only limited by the scope of the appended claims.

What is claimed is:

1. An enclosure for providing acoustic isolation from sounds within or without said enclosure formed from a plurality of muffler barriers joined together in contiguous air-tight relation, each said muffler barrier constructed to enclose a principal passage for the free flow of air therethrough in a direction substantially transverse to the principal direction of sound transmission without substantial reduction in the composite sound transmission loss through said enclosure, at least one said muffler barrier comprising:

a pair of substantially parallel leaves disposed in spaced apart relation, each comprising a rigid backing, the inwardly directed face of each of said leaves being lined with a layer of sound absorbing material impressed with a series of corrugations of saw-tooth cross-section longitudinally extended in a direction substantially parallel to a major edge of the said leaf, said leaves bonded together with the said corrugations in face-to-face relation at their apexes providing between them a series of longitudinal air channels comprising said principal air flow passage, air intake and exhaust openings respectively disposed at corresponding opposite positions near the ends of each of said leaves in transverse relationship to said longitudinal air channels, whereby the air intake is at one end of one said leaf and the air exhaust is at the other end of the other said leaf, with the longitudinal air channels extending between said openings.

2. An enclosure for providing acoustic isolation from sounds within or without said enclosure formed from a plurality of muffler barriers joined together in contiguous air-tight relation, each said muffler barrier constructed to enclose a passage for the free flow of air therethrough in a direction substantially transverse to the principal direction of sound transmission without substantial reduction in the composite sound transmission loss through said enclosure, at least one said muffler barrier comprising:

a pair of substantially parallel rigid leaves disposed in spaced apart relation and forming between them at least one closed internal chamber, the opposite internal leaves of said chamber being respectively lined with layers comprising a series of panels of laterally corrugated sound absorbing material interposed transversely between said leaves, said panels being disposed in substantially parallel non-contiguous relation forming between them channels comprising said passage for the free flow of air, at least one air intake opening on one said leaf leading into one end of said channels, and at least one corresponding air exhaust opening in the other said leaf leading out from the other end of said channels, said air flow channels thereby comprising a series of elongated zig-zag paths running at least part of the length of said walls between said intake and exhaust openings.

3. A muffler barrier comprising in combination a pair of rigid leaves each lined with a layer of sound absorbing material, each said layer of sound absorbing material impressed with a series of corrugations of saw-tooth cross-section longitudinally extended substantially parallel to a major edge of said leaf, said leaves bonded together with the said corrugations in face-to-face relation at their apexes providing between them a series of longitudinal air channels, intake and exhaust openings respectively disposed at correspoinding opposite positions near the opposite ends of each of said leaves in transverse relationship to said longitudinal air channels, whereby the air intake is at one end of one said leaf and the air exhaust is at the other end of the other said leaf with the longitudinal air channels extending between said openings.

4. An enclosure for providing acoustic isolation from sounds within or without said enclosure formed from a plurality of muffler barriers joined together in contiguous air-tight relation, said muffler barriers constructed to enclose a principal passage for the free flow of air therethrough in a direction substantially transverse to the principal direction of sound transmission without substantial reduction in the composite sound transmission loss through said enclosure, at least one said muffler barrier comprising:

a pair of substantially parallel leaves spaced apart by a series of symmetrically spaced longitudinally extending isolator studs forming between them a series of partially closed longitudinal chambers wherein said principal air flow passage comprises a plurality of channels extending in the direction of the major dimension of said leaves, air intake openings corresponding to each of said channels at one end of one said leaf and air exhaust openings corresponding to each of said channels at the other end of said other leaf, each of said leaves comprising a metal backing sheet, a first sound absorbing layer comprising a layer of glass fiber bonded to the inner surface of one said backing sheet, a foam laminate formed from layers of plastic foam bonded on opposite sides of a leaded transmission loss separator, a second sound absorbing layer comprising said foam laminate bonded to the inner surface of the other said backing sheet, wherein said air flow channels extend from said intake openings to said exhaust openings passing between said first and second sound absorbing layers.

* * * * *